US011258181B2

(12) United States Patent
Parsche

(10) Patent No.: US 11,258,181 B2
(45) Date of Patent: Feb. 22, 2022

(54) SYSTEMS AND METHODS FOR PROVIDING A HIGH GAIN SPACE DEPLOYABLE HELIX ANTENNA

(71) Applicant: Eagle Technology, LLC, Melbourne, FL (US)

(72) Inventor: Francis Parsche, Palm Bay, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 206 days.

(21) Appl. No.: 16/724,066

(22) Filed: Dec. 20, 2019

(65) Prior Publication Data

US 2021/0194140 A1 Jun. 24, 2021

(51) Int. Cl.
*H01Q 11/08* (2006.01)
*H01Q 1/36* (2006.01)

(52) U.S. Cl.
CPC ..... *H01Q 11/08* (2013.01); *H01Q 1/362* (2013.01)

(58) Field of Classification Search
CPC .... H01Q 11/08; H01Q 11/086; H01Q 11/083; H01Q 1/362
See application file for complete search history.

(56) References Cited

U.S. PATENT DOCUMENTS 3,699,585 A * 10/1972 Morrison ..... H01Q 11/086 343/880
5,329,287 A * 7/1994 Strickland ..... H01Q 11/08 343/752
5,668,559 A * 9/1997 Baro ..... H01Q 1/242 343/702
5,892,480 A * 4/1999 Killen ..... H01Q 1/362 343/895
5,909,197 A 6/1999 Heinemann et al.
6,115,005 A 9/2000 Goldstein et al.
6,344,834 B1 * 2/2002 Josypenko ..... H01Q 1/362 343/895
6,545,649 B1 4/2003 Seavey
6,836,257 B2 12/2004 Louvigne et al.
8,436,784 B2 5/2013 Jalali Mazlouman et al.
2011/0298688 A1 12/2011 Jalali Mazlouman et al.
2012/0146880 A1 * 6/2012 Behrens ..... B64G 1/222 343/895
2012/0256797 A1 10/2012 Strickland et al.

FOREIGN PATENT DOCUMENTS

CA 2118082 A 4/1995
CN 104638348 B 6/2017
EP 2489098 B 4/2015

* cited by examiner

*Primary Examiner* — Dameon E Levi
*Assistant Examiner* — Jennifer F Hu
(74) *Attorney, Agent, or Firm* — Fox Rothschild LLP; Robert J. Sacco; Carol E. Thorstad-Forsyth

(57) ABSTRACT

Systems and methods for improving an efficiency and a gain of a helical antenna. The methods comprise: configuring a conductive helix element of the helical antenna to comprise a proximal segment having a helical winding that extends along an axis of the conductive helix element and has a plurality of turns with linearly progressing pitch angles; configuring the conductive helix element to comprise a distal segment having a helical winding that extends along the axis of the conductive helix element and has a constant pitch angle; and coupling the distal segment to the proximal segment in a series arrangement so that a radio wave reaches a terminal velocity at a point of the coupling.

22 Claims, 13 Drawing Sheets

SYSTEMS AND METHODS FOR PROVIDING A HIGH GAIN SPACE DEPLOYABLE HELIX ANTENNA

BACKGROUND

Statement of the Technical Field

The present disclosure relates generally to communication systems. More particularly, the present disclosure relates to systems and methods for providing a high gain space deployable helix antenna.

Description of the Related Art

Satellites have become essential for the many purposes of communications, navigation, and timing. Radio linking to space is, of course, practical over a wide frequency range. However, VHF and UHF frequencies offer particular advantages. For instance, higher frequencies can be limited by atmospheric absorption and rain fading. Antennas at lower frequencies provide the combination of large receive aperture/capture area and broad antenna beamwidth at the same time which can reduce or eliminate antenna aiming requirements. Further advantaging lower frequencies is the earth's distance from the sun, which provides a broad band low noise window at UHF. Above about 300 MHz frequency, solar noise becomes predominant. Galactic noise becomes predominant below 300 MHz. In tropical jungles, the tree canopies cannot be penetrated at elevated frequency. At 300 MHz, a jungle canopy in Panama has been measured to cause 4 decibels of signal attenuation towards zenith, but at 3000 MHz the attenuation increased above 20 decibels. These are some of the factors that make UHF and VHF frequency ranges preferential for satellite to earth mobile station linking.

Smaller satellites have become popular for sake of economy. As antenna size is inversely related to frequency, the lower frequency antennas can be large relative the size of small satellites. For instance, a half wave dipole antenna for 300 MHz may be about 0.5 meters long, yet a ½ ESPA size satellite measures 0.63×1.0×1.15 meters. Given the competition between battery, solar cells and electronics for satellite resources, a means of antenna stowage can be needed. The antenna must make efficient use of weight as well.

Space based communication systems often employ helical antenna structures that are deployable. The helical antenna comprises one or more conducting wires wound in the form of a helix. Directional helical antennas are mounted over a ground plane structure to avoid backlobe radiation. The feed line is connected between the bottom of the helical antenna and the ground plane structure. Directional helical antennas operate in two modes: a normal mode and an axial mode. In normal mode, the diameter and the pitch of the windings are relatively small compared with the wavelength and a standing wave current flows. In axial mode, the circumference of each turn of the windings are comparable with the wavelength and traveling wave current flows. Axial mode antennas provide a directive beam.

SUMMARY

The present disclosure concerns implementing systems and methods for improving an efficiency and a gain of a helical antenna. The methods comprise: configuring a conductive helix element of the helical antenna to comprise a proximal segment having a helical winding that extends along an axis of the conductive helix element and has a plurality of turns with linearly progressing pitch angles; configuring the conductive helix element to comprise a distal segment having a helical winding that extends along the axis of the conductive helix element and has a constant pitch angle; and coupling the distal segment to the proximal segment in a series arrangement so that a radio wave traveling along the conductive helix element reaches a terminal velocity at a point of the coupling.

The helical windings of the proximal and distal segments may have constant diameters. The spacing between successive turns of at least the proximal segment's helical winding may be constant or varied along a line parallel to the axis. The linearly progressing pitch angles and the constant pitch angle may be selected so that a radio wave velocity matches a current velocity at any location along the length of the conductive helix element.

In some scenarios, the methods comprises an elongate support member structurally supporting the conductive helix element. The an elongate support member is disposed inside of the conductive helix element and extends along the axis. The conductive helix element is mechanically coupled to the elongate support member using a plurality of struts. The elongate support member may be axially expansive. The conductive helix element may further be structurally supported by sewn longitudinal tapes or an outer fabric sleeve.

In those or other scenarios, the methods comprise coupling the proximal segment of the conductive helix element to a ground plane structure. The ground plane structure comprises a deployable ground plane structure or a cup reflector. The deployable ground plane structure comprises a solid plate to which a webbed structure is coupled via a plurality of joints such that the webbed structure is able to move in directions towards and away from the conductive helix element. A solid disc may be suspended over the distal segment of the conductive helix element.

The present disclosure also concerns helical antennas. The helical antennas comprise a conductive helix element. The conductive helix element comprises: a proximal segment having a helical winding that extends along an axis of the conductive helix element and has a plurality of turns with linearly progressing pitch angles; and a distal segment having a helical winding that extends along the axis of the conductive helix element and has a constant pitch angle. The distal segment is coupled to the proximal segment in a series arrangement so that a radio wave traveling along the conductive helix element reaches a terminal velocity at a point of the coupling.

In some scenarios, an elongate support member is disposed inside of the conductive helix element and extends along the axis so as to provide structural support to the conductive helix element. The conductive helix element is mechanically coupled to the elongate support member using a plurality of struts. The elongate support member may be axially expansive. The conductive helix element may further be structurally supported by sewn longitudinal tapes or an outer fabric sleeve.

A ground plane structure may be provided to which the proximal segment of the conductive helix element is coupled. The ground plane structure comprises a deployable ground plane or a cup reflector. The deployable ground plane structure comprises a solid plate to which a coil structure is coupled via a plurality of joints such that the coil structure is able to move in directions towards and away from the conductive helix element. A solid disc may be suspended over the distal segment of the conductive helix element.

BRIEF DESCRIPTION OF THE DRAWINGS

The present solution will be described with reference to the following drawing figures, in which like numerals represent like items throughout the figures.

DETAILED DESCRIPTION

Figure 1:
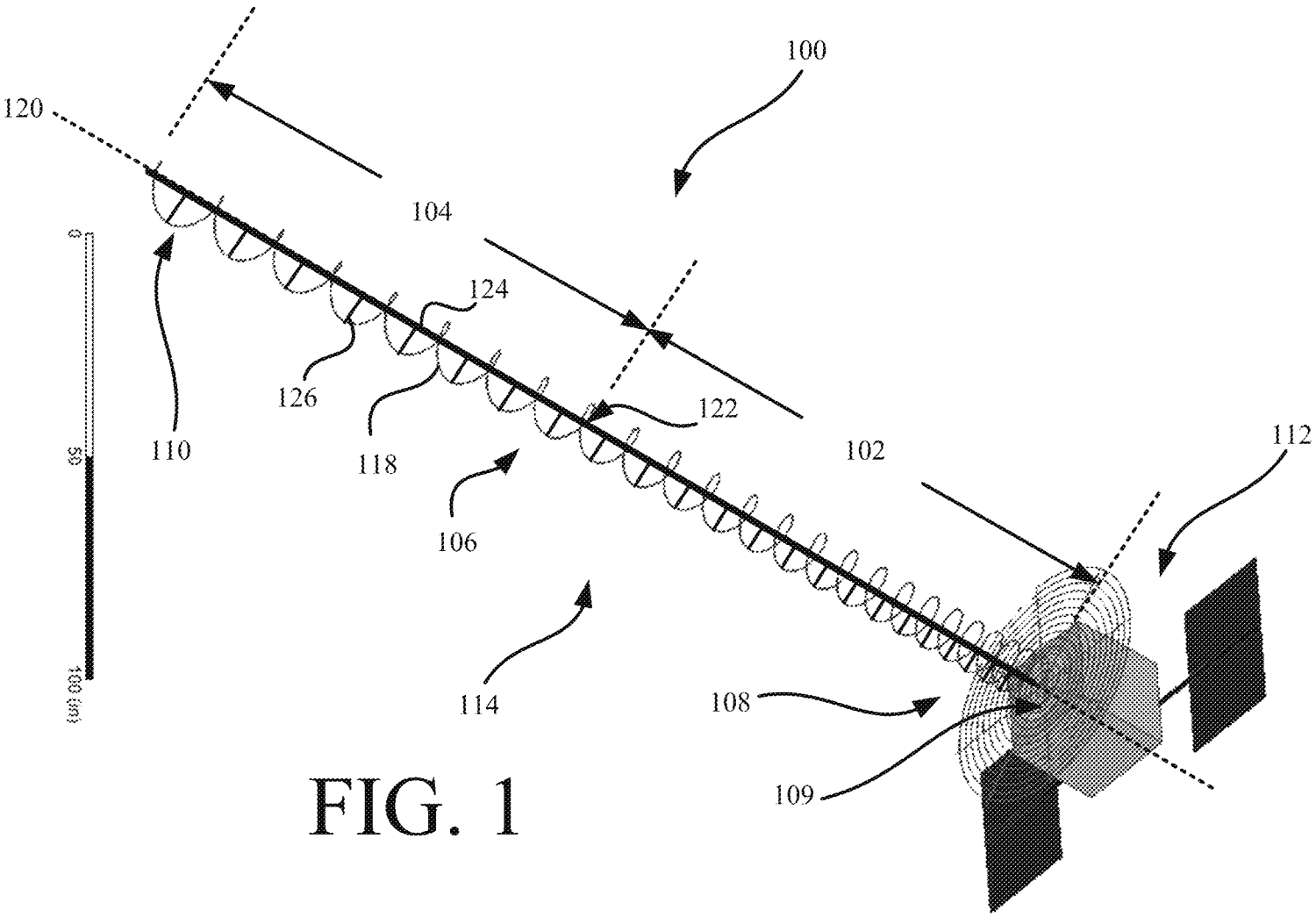
FIG. 1 is a perspective view of an illustrative satellite.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

In this document, when terms such "first" and "second" are used to modify a noun, such use is simply intended to distinguish one item from another, and is not intended to require a sequential order unless specifically stated.

The present solution is described herein in relation to space based communication applications. The present solution is not limited in this regard. The present solution may also be used in ground based communication applications.

Referring now to FIG. 1, there is provided an illustration of a satellite 100 with a space deployable antenna element 114 coupled to communications equipment 112. Communications equipment for satellites is well known in the art, and therefore will not be described in detail herein. The communications equipment can include, but is not limited to, solar panels, a Radio Frequency ("RF") amplifier, a transceiver, and/or impedance matching circuitry. The communications equipment 112 is electrically connected to the antenna element 114 so that (A) an RF signal may be provided from the communications equipment 112 to the antenna element 114 when the satellite 100 is being used as an RF wave launching device or (B) an RF wave may be provided from the antenna element 114 to the communications equipment 112 when the satellite 100 is being used as a wave-receiving device.

The antenna element 114 comprises a deployable ground plane structure 108 cooperating with a helical antenna 106 coupled thereto. The antenna element 114 is operable at relatively low frequencies (e.g., 350 MHz-380 MHz) and has a relatively high gain (e.g., 17 dBi) at these relatively low frequencies.

Figure 2:
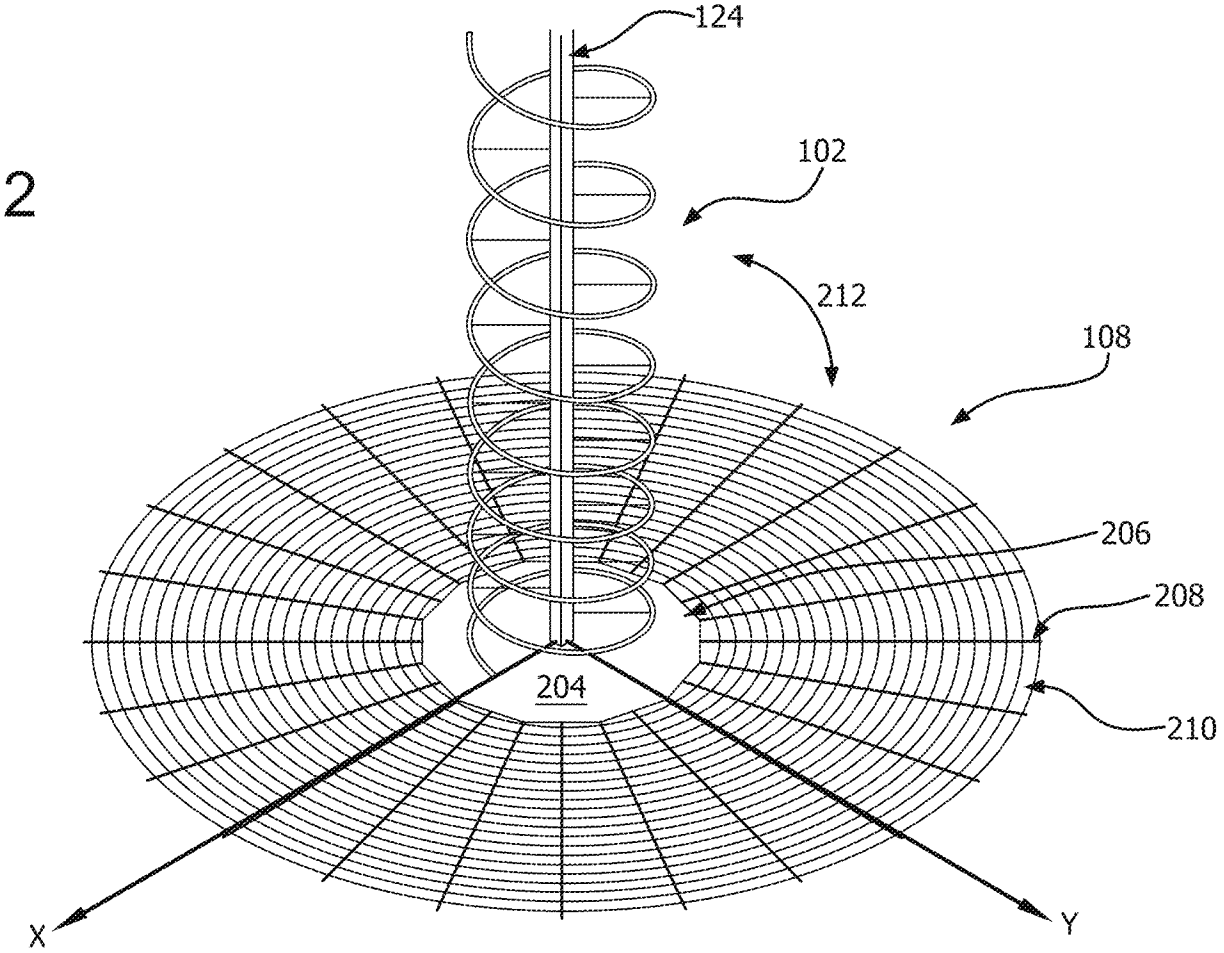
FIG. 2 is a perspective view of the antenna element of the satellite shown in FIG. 1.
Figure 3:
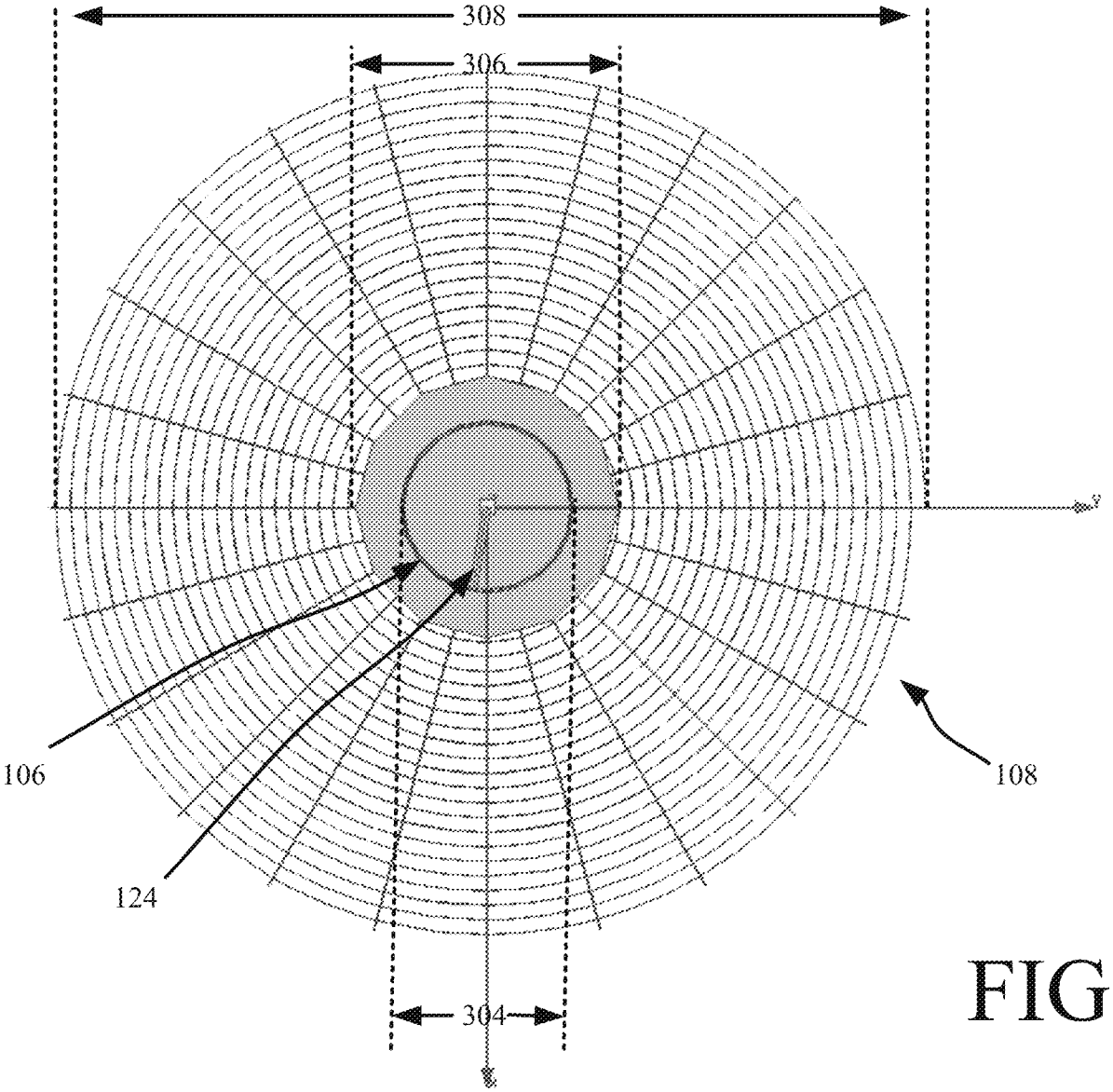
FIG. 3 is top view of the antenna element shown in FIGS. 1-2.
Figure 4:
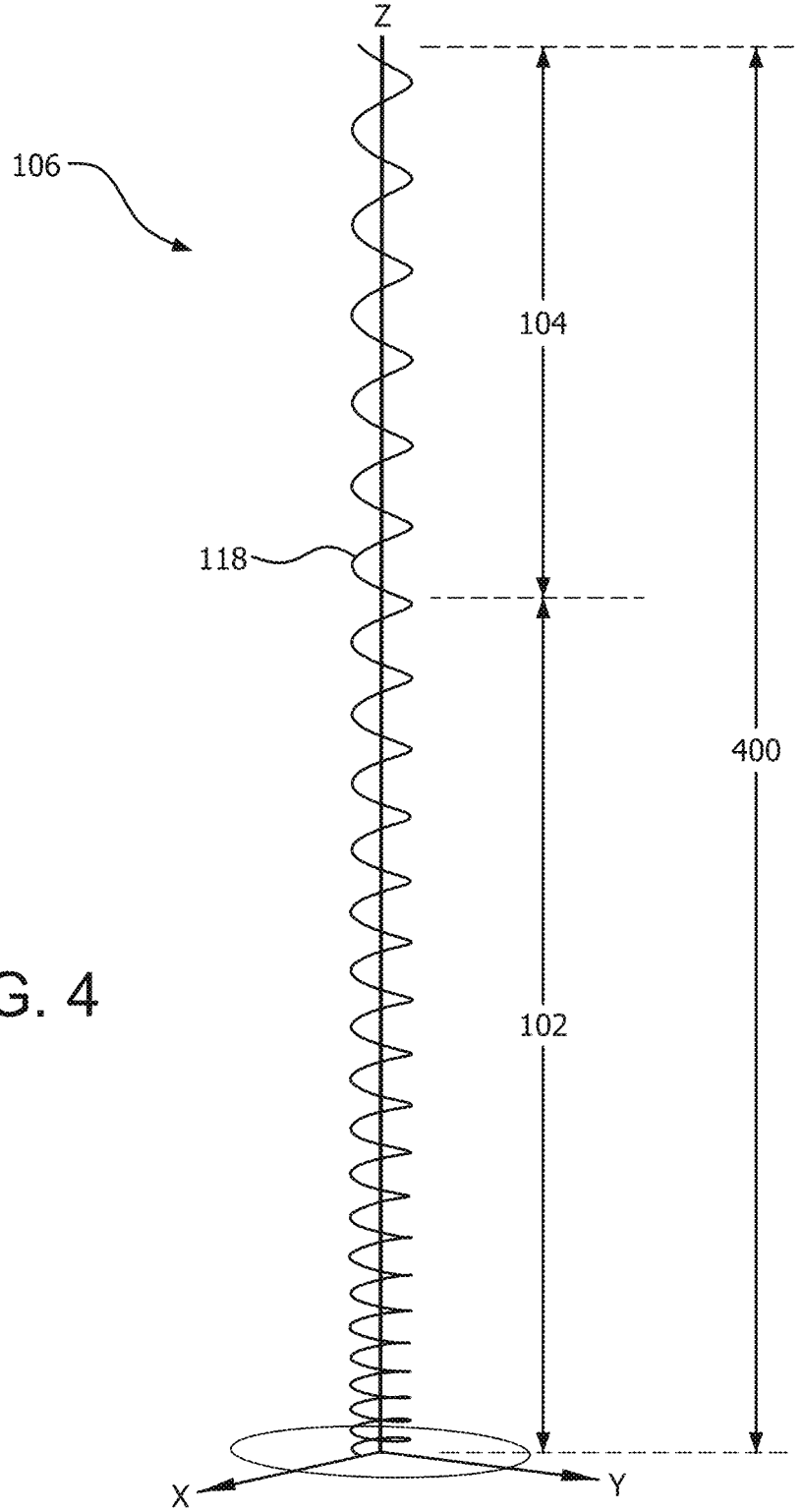
FIG. 4 is side view of the antenna element shown in FIGS. 1-3.

As shown in FIGS. 1-3, the ground plane structure 108 is coupled to a proximal end 108 of the helical antenna 106. Charge is separated between the ground plane structure 108 and the helical antenna 106 at a small discontinuity or feed gap 109 located between the ground plane 108 and the helical antenna 106. There RF power is applied to and received from the antenna by a coaxial cable (not shown). Impedance matching components may also be present to convert the antenna circuit impedance to 50 ohms or other values. The ground plane structure 108 comprises a solid plate 204, joints 206, ribs 208 and a webbed structure 210. The solid plate and webbed structure may have a circular cross-sectional profile. The solid plate 204 has a diameter 306 that is smaller than the diameter 308 of the webbed structure 210. In some scenarios, diameter 306 is less than or equal to one third of diameter 308. For example, diameter 306 is between ten and twenty inches, while diameter 308 is between fifty-five and sixty inches. The present solution is not limited to the particulars of this scenario and/or example. For example, the solid plate and webbed structure can have other non-circular cross-sectional profiles (e.g., square cross-section profiles).

The joints 206 facilitate the movement of ribs 208 in directions towards and away from the helical antenna 106, as shown by arrow 212. In some scenarios, the joints 206 include hinges and/or ball bearings coupled between the solid plate 204 and the ribs 208. Hinges and ball bearings are well known in the art, and therefore will not be described herein. The present solution is not limited in this regard. Other joint mechanisms can be employed here. The joints allow the ground plane structure 108 to be transitioned from a stowed position in which the webbed structure 210 is closed around the helical antenna 106 to a deployed position in which the webbed structure 210 is open as shown in FIG. 1.

The ribs 208 are formed of a rigid material, such a metal or plastic. The webbed structure 210 is coupled to the ribs 208 via any suitable coupling means (e.g., an adhesive, ties, clamps, welds, etc.). The webbed structure 210 comprises one or more wires with turns wound around the axis 120 on a flat plane when the webbed structure 210 is in its deployed position shown in FIG. 1. The wire(s) is(are) formed of flexible or semi-flexible material so that the same can be transitioned from a closed position (not shown) to an open position shown in FIG. 1. If more than one wire is employed, then the wires can have the same wind directions or opposite wind directions (e.g., counter-wound spirals). The wires may alternatively or additionally have the same or different number of turns and/or spacing between the turns. The webbed structure 210 can have a spiral coil configuration as shown in FIGS. 1-3 (e.g., a 21 facet spiral coil), a polygon coil configuration (e.g., a 16 facet polygon coil), or any other coil shape configuration selected in accordance with a given application.

As shown in FIGS. 1-6, the helical antenna 106 comprises a conductive helix element 118 helically wound along an axis 120, which coincides with the boresight of the antenna element 114. The conductive helix element 118 is coupled to and structurally supported by a bar 124 via arms, struts or posts 126. Bar 124 is aligned with and extends along axis 120 as shown in FIG. 1. Bar 124 is formed of a rigid material, such as a metal or plastic. Arms, struts or posts 126 are formed of a rigid or semi-rigid material (e.g., metal or plastic). The arms or posts 126 can be provided at regular or irregular intervals along the length of the bar 124, i.e., adjacent arms or posts have the same or different spacing therebetween.

In some scenarios, bar 124 comprises an axially expansive bar that transitions from a retracted position (not shown) to an extended position shown in FIG. 1. Axially expansive bars are well known in the art, and therefore will not be described herein. For example, the axially expansive bar includes a telescoping bar. The axially expansive feature of the bar facilitates stowing of the satellite 100 in a relatively small area of a spacecraft or aerial vehicle. The present solution is not limited to the particulars of this scenario.

In those or other scenarios, sewn longitudinal tapes or an outer fabric sleeve is provided to further structurally support the conductive helix element 118 and constrain the expansion of the conductive helix element 118 caused by vibration. The longitudinal tapes and/or outer fabric sleeve is(are) not shown for ease of illustration. The present solution is not limited in this regard.

The conductive helix element 118 extends along the axis 120, has a helix circumference (e.g., 1.0λ to 1.2λ), an outer diameter 304 (e.g., 10.310 or 11.87 inches), and a length 400 (e.g., 275.21 inches). The conductive helix element 118 is shown as comprising a circular cross-section helix. The present solution is not limited in this regard. The conductive helix element 118 can alternatively comprise a square cross-section helix (e.g., with a 0.16"×0.16" square helix conductor diameter), a rectangular cross-section helix, a triangular cross-section helix, or any other shaped helix. The conductive helix element 118 is formed of any conductive wire. The conductive wire may be insulated or uninsulated, and formed of any conductive material (e.g., a nickel-titanium alloy, copper or aluminum).

Figure 5:
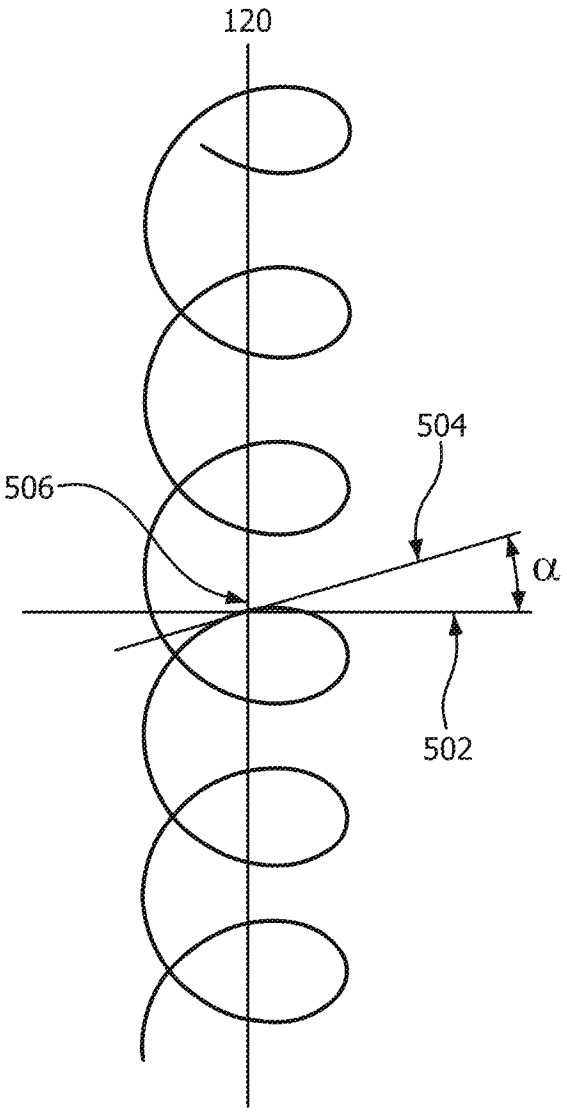
FIG. 5 is an illustration that is useful for understanding a winding pitch of a helix antenna.

The conductive helix element 118 comprises a proximal segment 102 and a distal segment 104. During transmit operations, current and radio waves travel along the conductive helix element 118 from its proximal end 108 to its distal end 110. The conductive helix element 118 has a winding pitch angle at any location along its length that is tailored to optimize the exchange of energy between a free space wave and current flowing in the conductive helix element 118. The winding pitch angles are selected so that the radio wave velocity matches the current velocity at any location along the length of the conductive helix element 118. As illustrated in FIG. 5, the winding pitch angle is the angle α between a plane 502 normal to the boresight axis 120 and a line 504 tangential to the selected location 506 on the conductive helix element 118.

Considering the antenna space deployable antenna element 114 to be transmitting speed of a radio wave increases along the length of the helical antenna 106, i.e., the radio wave has a slowest speed at the proximal end 108 of the conductive helix element 118 and a fastest speed at the distal end 110 of the conductive helix element 118. The radio wave reaches a terminal velocity at a point 122 (e.g., a midpoint) somewhere between ends 108, 110 of the conductive helix element 118. A linearly progressing winding pitch angle α is used for the proximal segment 102 of the conductive helix element 118. The proximal segment 102 extends between the ground plane structure 108 and point 122. The winding pitch angle of successive turns of the proximal segment 102 are varied in linear manner (e.g., is increased by a number between 0.1 degrees and 5.0 degrees for each turn). The smallest value of the linear progressing winding pitch angle α (e.g., 1°-8°) is at the proximal end 108 of the proximal segment 102, while the largest value of the linear progressing winding pitch angle α (e.g., 20°-30°) is at the distal end 122 of the proximal segment 102. If effect, there are more turns per inch close to the proximal end 108 and fewer turns per inch close to point 122. The linearly progressing winding pitch angle α produces reduced side lobes, more gain per length and more bandwidth. The several winding pitches regions provide several distinct functions: (1) the tighter winding pitch at the proximal end traps the wave energy within a small distance from the helix; (2) the moderate pitch in the medial regions continues to guide the developing wave with reduces sidelobes; and (3) the large pitch at the distal edge is advantaged for wave release at the end antenna.

In some scenarios, the linear progressing winding pitch angle α may have a value on the order of 0-30 degrees at a given location on the conductive helix element 118. The present solution is not limited in this regard. The linear progressive winding pitch may aid in trapping and later releasing a surface wave to provide a lens effect and directivity increase.

In some scenarios, the winding pitch angle α of the first wind (i.e., the most proximal wind) of the proximal segment 102 may be selected to facilitate impedance matching of the antenna element 114 with the communications equipment 112. In some scenarios, the winding pitch angle α of the first wind is selected to be 1°-5° such that a 50 Ohm resistance is provided by the antenna element 114. The present solution is not limited in this regard.

In other scenarios, a transformer and/or other impedance matching circuit components (e.g., an inductor or resistor) is(are) used to provide the impedance matching between the antenna element 114 with the communications equipment 112. The present solution is not limited in this regard.

The helix winding spacing of the proximal segment 102 is defined by the following Mathematical Equation (1).

$$S=Xn+C \tag{1}$$

where S represents the spacing between two successive turns (or z axis rate of expansion), X represents a linear coefficient (e.g., 0.0137), n represents the turn number (e.g., 25 or 27), and C represents a constant (e.g., 0.1361). As evident from this mathematical equation (1), the spacing between successive turns varies within the proximal segment 102. For example, the spacing between successive turns increases from the proximal end 108 to the point 122.

The helix antenna 106 advances both a traveling wave electrical current along the helix axis conductor and an attached surface wave surrounding the helix. It has been found that in some instances, such as high gain embodiments, the velocity of the attached surface wave transmitted by the helix antenna 106 reaches a certain maximum or constant terminal velocity along the helix axis. This is particularly the case for longer helix antennas 106. For this reason a constant winding pitch angle α is used for the distal segment 104 of the conductive helix element 118. In some scenarios, the linear progressing winding pitch angle α has a value equal to the largest pitch angle value of the proximal segment 102 (e.g., on the order of 6-30 degrees). The present solution is not limited in this regard.

Figure 7:
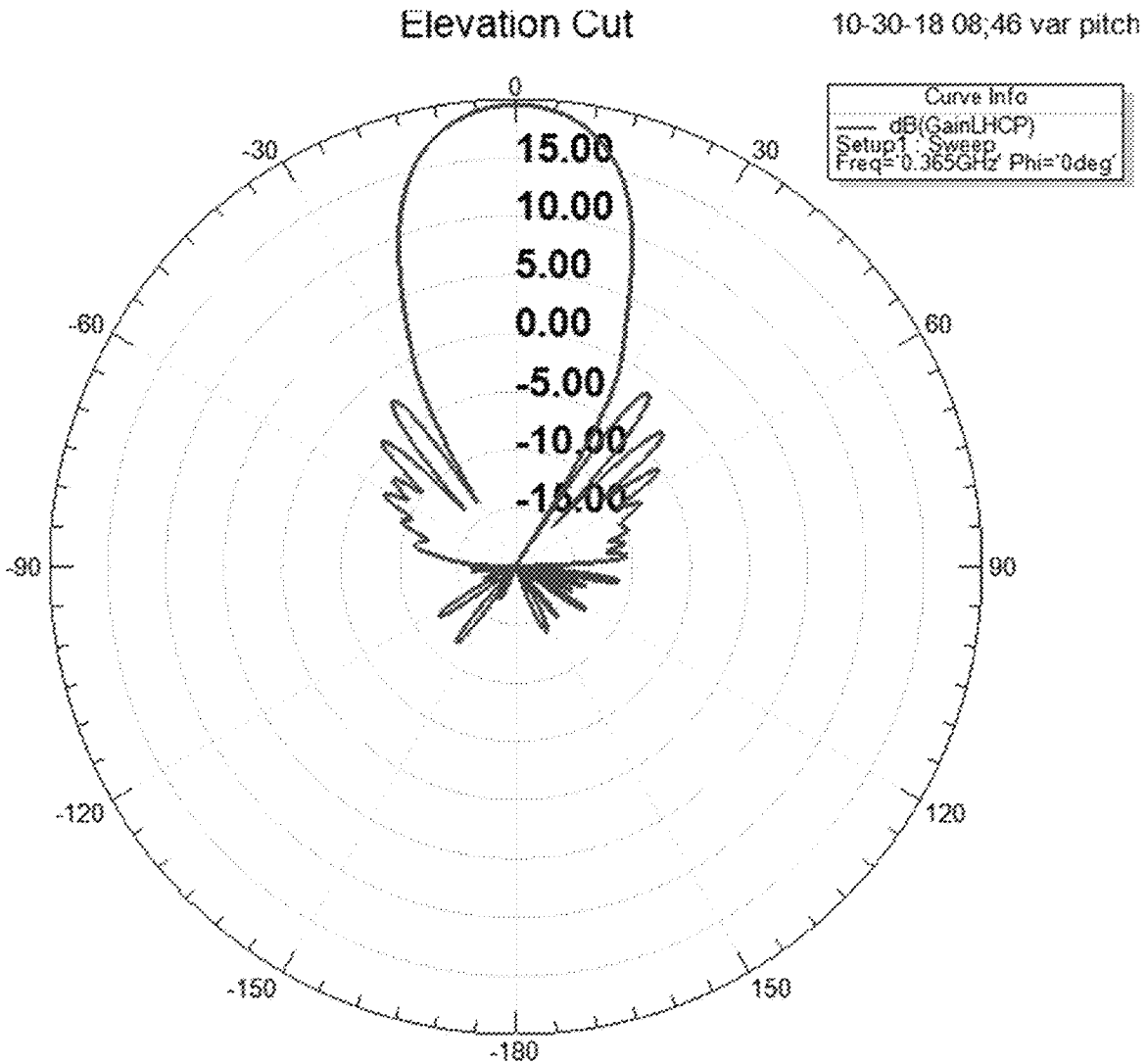
FIG. 7 is an illustration showing a beam pattern for an antenna element designed in accordance with the present solution.
Figure 8:
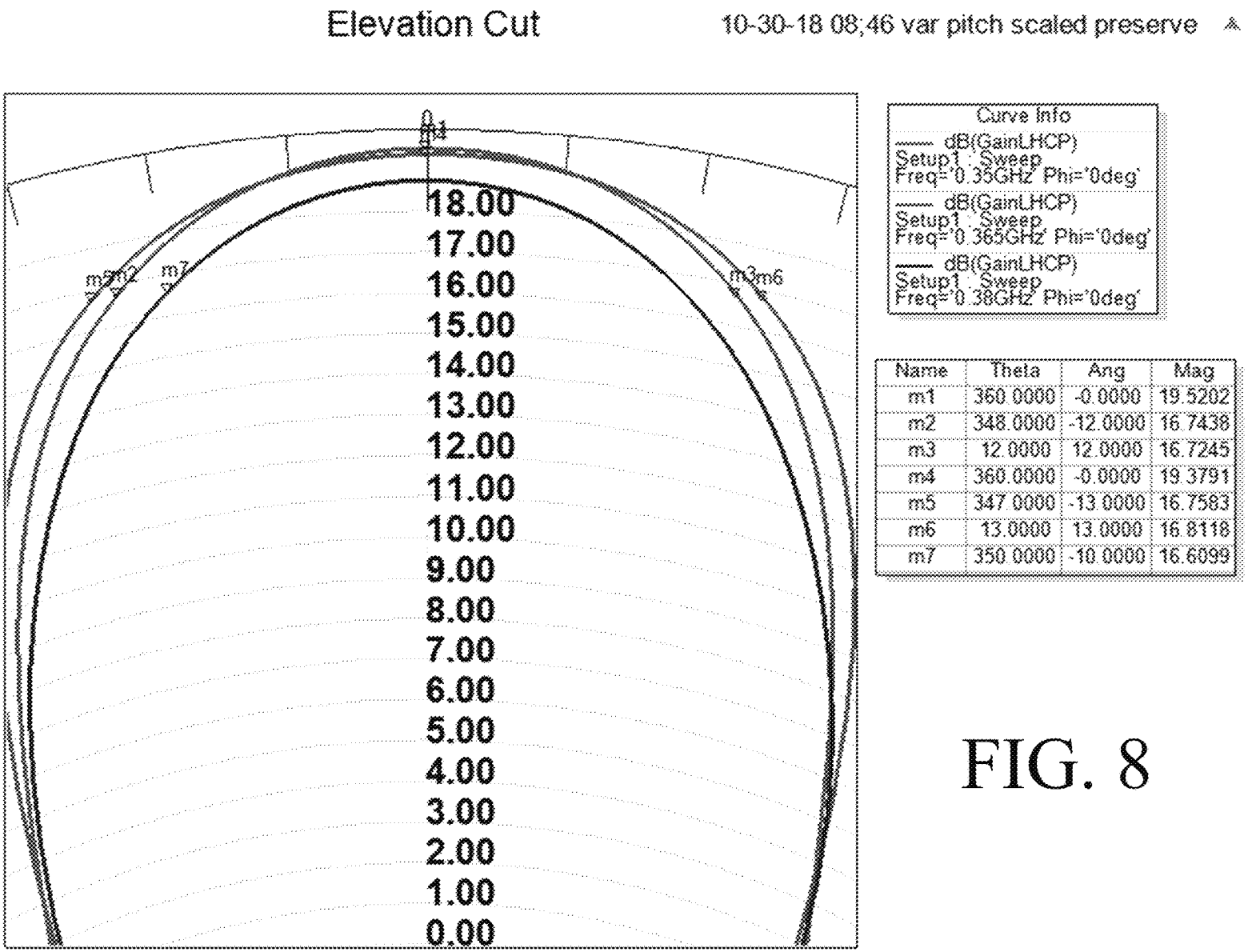
FIG. 8 is an illustration showing a beam pattern for an antenna element designed in accordance with the present solution.

The distal segment 104 extends between point 122 and distal end 110 of the helical antenna 106. The length of the distal segment (e.g., ≤3.5 meters) can be selected to provide a desired beam width (e.g., a 3 dBi beam width) and antenna gain (e.g., 19.5 dBi). Graphs showing an illustrative beam and beam width for a simulated antenna are provided in FIGS. 7-8. In FIGS. 7-8, a simulated antenna produced a maximum gain of 19.5 dBi at a midband frequency of 365 MHz. A 3 dB beamwidth of 24 degrees was realized. A feature of the present solution is reduced sidelobe levels relative helix antennas having a constant winding pitch throughout. The radiation pattern of FIG. 7 shows the greatest sidelobe to be 21 dB down from the main lobe. In contrast, prior art constant winding pitch axial mode helix antennas may typically have sidelobes 13 dB down from the main lobe. Reduced amplitude sidelobes from the present solution may reduce interference with other spectrum users. The present solution is not limited to the particulars of this simulation scenario.

Figure 6:
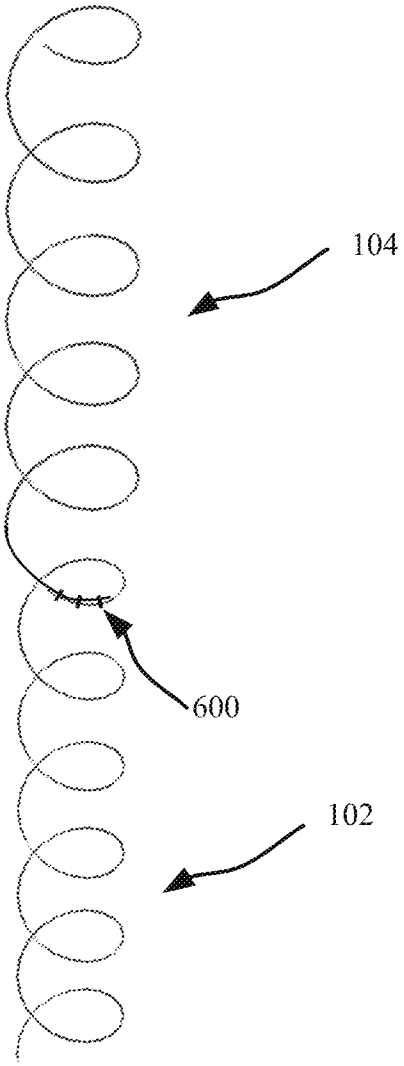
FIG. 6 is an illustration that is useful for understanding how adjacent portions of a helix antenna are coupled to each other.

The proximal segment 102 and the distal segment 104 of the conductive helix element 118 may comprise a single part or structure. Alternatively, the two segments 102, 104 are coupled to each other via one or more couplers 600 as shown in FIG. 6. The couplers 600 include, but are not limited to, adhesives (not shown), a weld (not shown), crimps, windings there around, and/or mechanical crimped ferrules (shown in FIG. 6). The two segments 102, 104 are arranged so that they overlap each other by a certain amount (e.g., ¼λ). Notably, the overlapping portions of the two segments 102, 104 can be in electrically conductive contact with each other or can be spaced apart from each other and not in electrical contact with each other. In the spaced apart scenarios, inductive coupling is provided between the two spliced segments 102, 104. Couplers 600 may allow the helix antenna structure to be manufactured in smaller portions. Smaller manufacturing portions may beneficially permit the use of a reduced size furnace if the helix is to be spring tempered.

In some scenarios, each of the segments 102 and 104 can be formed of two or more sub-segments. The sub-segments may be joined to teach other in the same or similar manner as that discussed above in relation to the splicing of segments 102 and 104 (e.g., via an adhesive, a weld (not shown), a crimp, a winding there around, and/or mechanical crimped ferrules).

Figure 9:
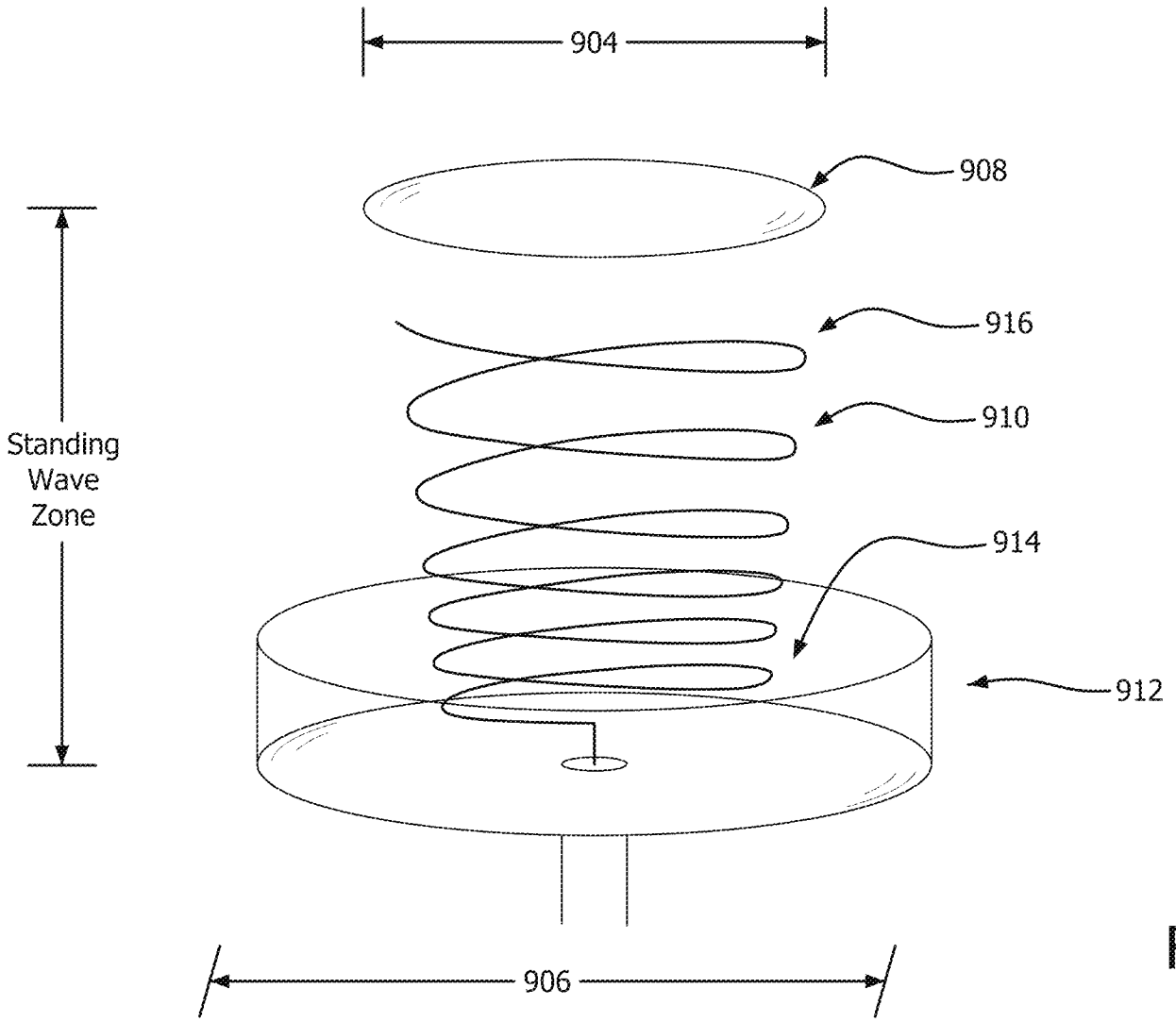
FIG. 9 is an illustration showing another illustrative architecture for an antenna element.

Referring now to FIG. 9, there is provided an illustration of another illustrative architecture for a helical antenna 900 designed in accordance with the present solution. The helical antenna 900 comprises a ground plane structure 912 coupled to a proximal end 914 of a conductive helix element 910. The conductive helix element 910 is an axial mode helical antenna element that is the same as or similar to the conductive helix element 118 discussed above. As such, the discussion of the conductive helix element 118 is sufficient for understanding conductive helix element 910.

The ground plane structure 912 comprises a cup reflector 912 instead of a solid plate 204. Cup reflector 912 may function as a waveguide cavity. Cup reflectors are well known in the art, and therefore will not be described further herein. The cup reflector 912 prevents any unwanted back lobe radiation. The cup reflector 912 has a diameter 906 selected in accordance with a particular application (e.g., 2λ, 1.58λ, Bessel zero circumferences, etc.).

A solid disc 908 is suspended above the distal end 916 of the conductive helix element 910. The solid disc 908 is formed of an electrically conductive material, such as metal (e.g., aluminum, graphite, or copper). The solid disc 908 has a diameter 904 selected in accordance with a given application (e.g., 0.4λ, to 0.6λ). The solid disc 908 reflects some of the energy back towards the cup reflector 912 so as to provide backwards or standing wave, and a Fabry Perot resonator effect. As a result of the Fabry Perot resonator effect, the directivity of the helical antenna 900 is increased as compared to that of a conventional helix antenna. Accordingly, the solid disc 908 is a beam narrowing feature and a gain enhancing feature of the helical antenna 900. It is also contemplated to make a conductive electrical connection between the solid disc 908 and the distal end 916 or the helix element 910 with directive gain increase, which may benefit structural implementation.

Figure 10:
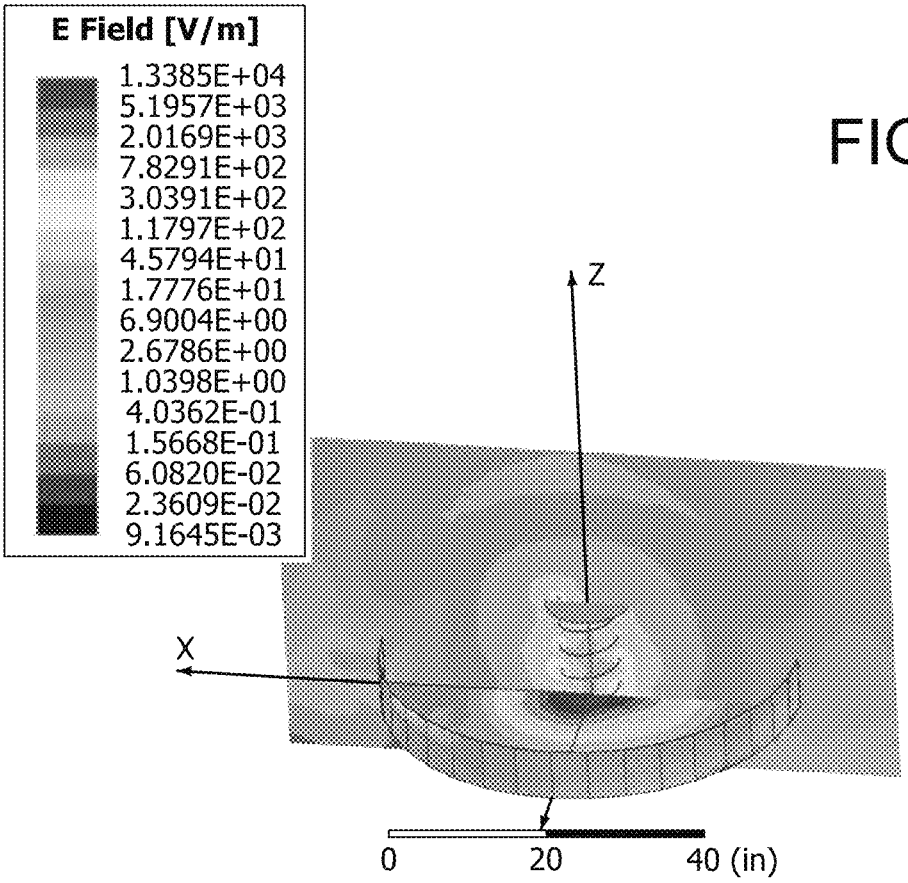
FIGS. 10-11 provide illustrations that show gains of an illustrative antenna element.
Figure 10:
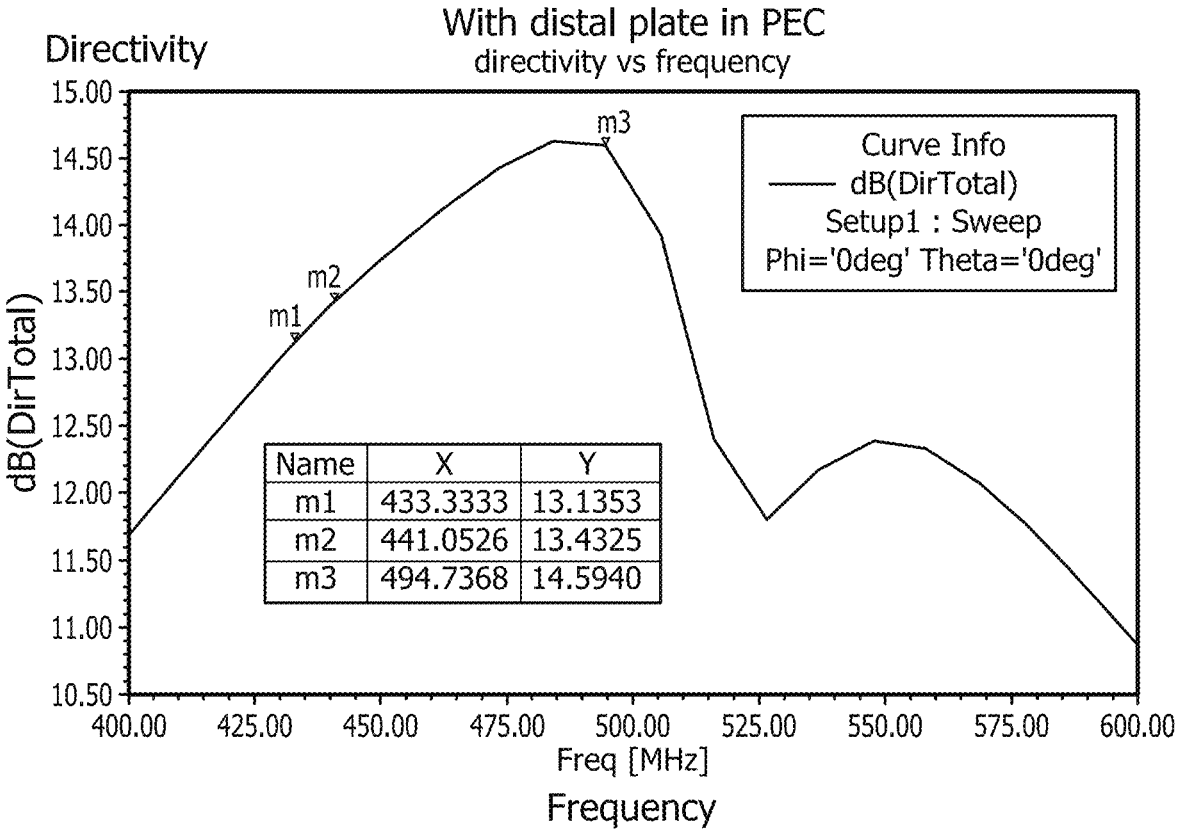
Figure 11:
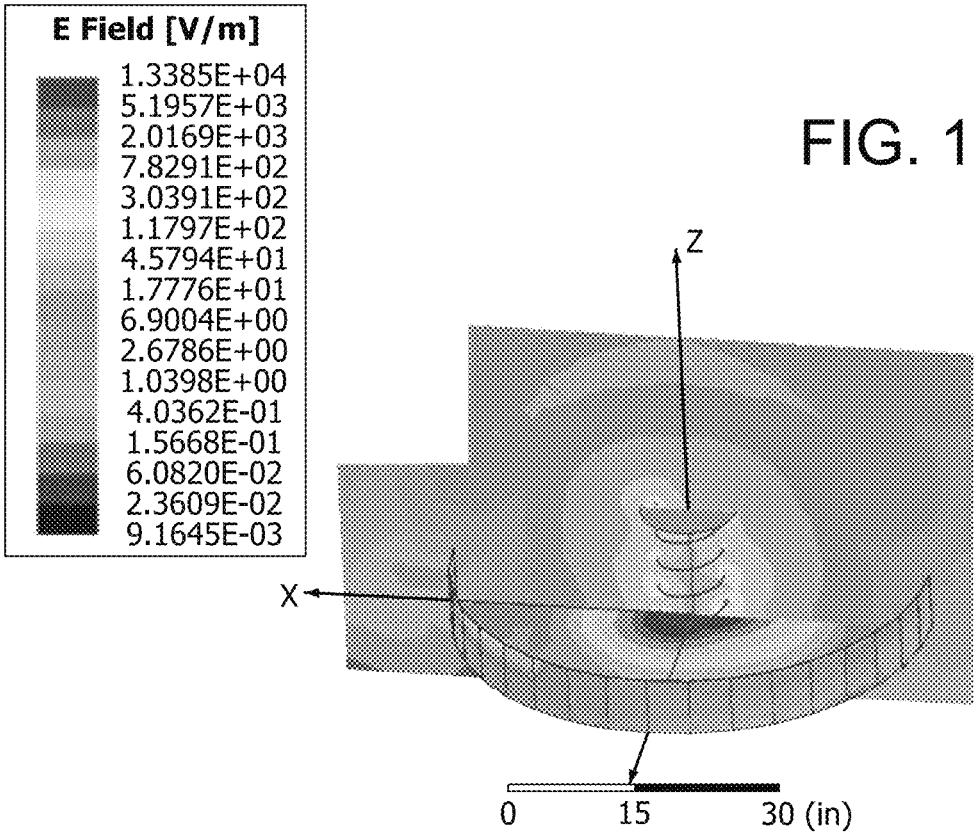
Figure 11:
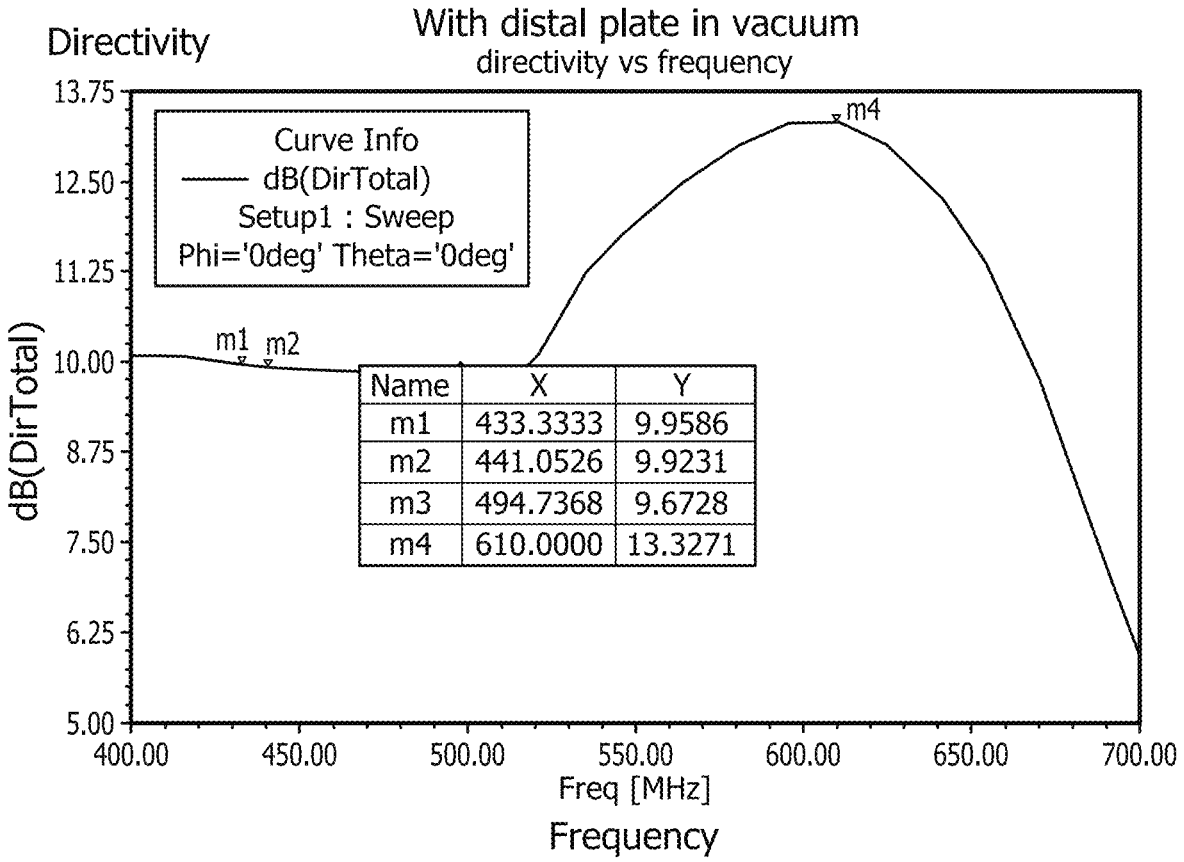

FIGS. 10 and 11 provide graphs showing the gain enhancement of the helical antenna 900. The graphs show that a 1.3 dB increase in realized gain was provided by the inclusion of the solid disc 908. The solid disc 908 gain enhancement is caused by making the antenna energies transverse the helix more than once by providing a standing wave or backwards wave motion wave over the helix structure. Overall antenna length is adjusted to cause the forward wave and the backwards wave to add in phase for radiation. The directive gain increase provided by the solid disc 908 was caused without increasing the helix length.

Figure 12:
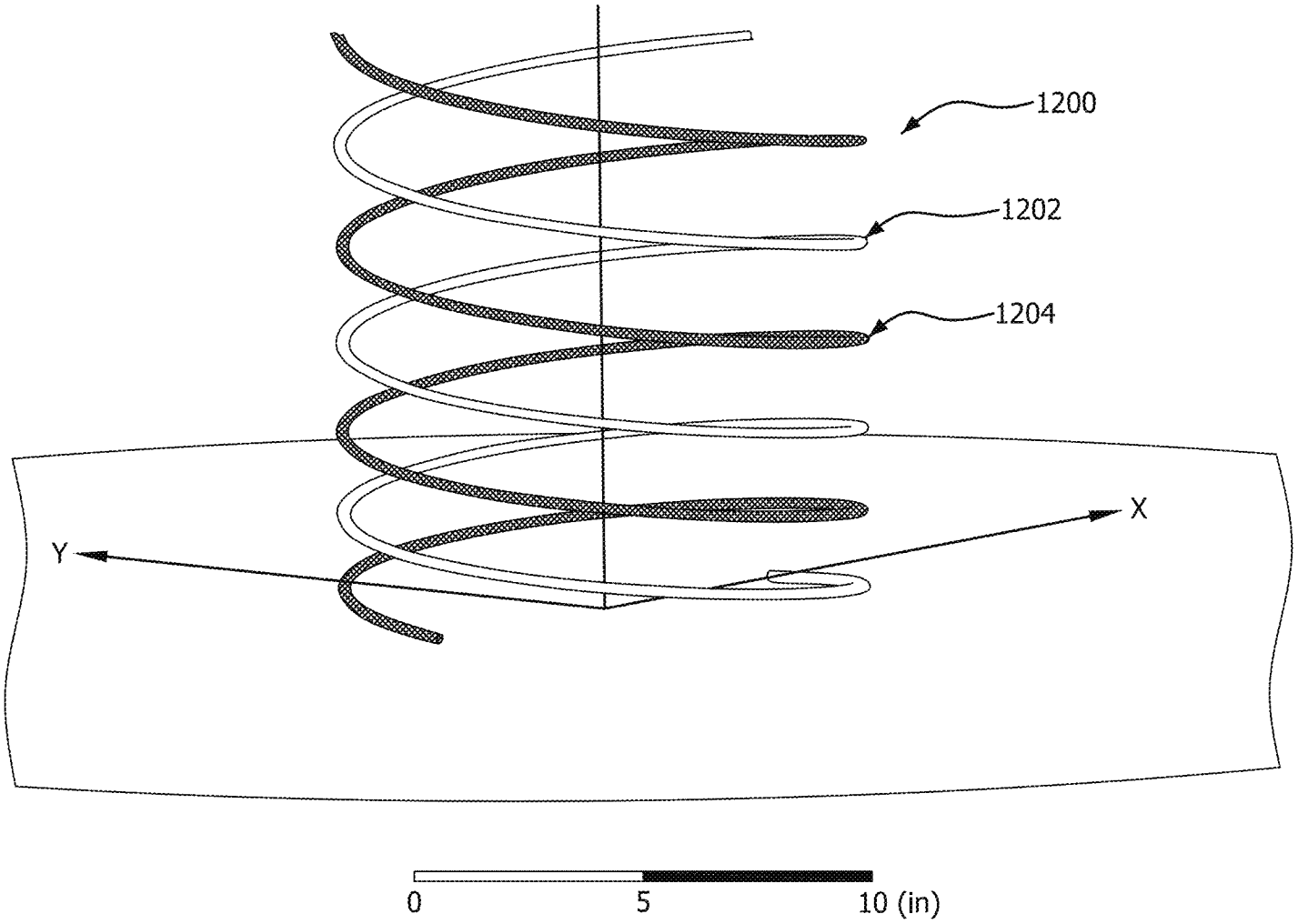
FIG. 12 is an illustration of a multi-filar helical configuration for a helix antenna.

Referring now to FIG. 12, there is provided an illustration of conductive helix element 1200 with a multi-filar helical configuration instead of a mono-filar configuration shown in FIGS. 1-6. The multi-filar helical configuration of FIG. 12 comprises a bi-filar helix. The two helix structures 1202, 1204 can be the same as or different than the conductive helix element 118 of FIGS. 1-6. The two or more helix structures 1202, 1204 can also be the same as or different than each other. The two helix structures 1202, 1204 can offer advantages of polarization that is more circular with a lower axial ratio and a more symmetric beam in azimuth than one helix structure.

Figure 13:
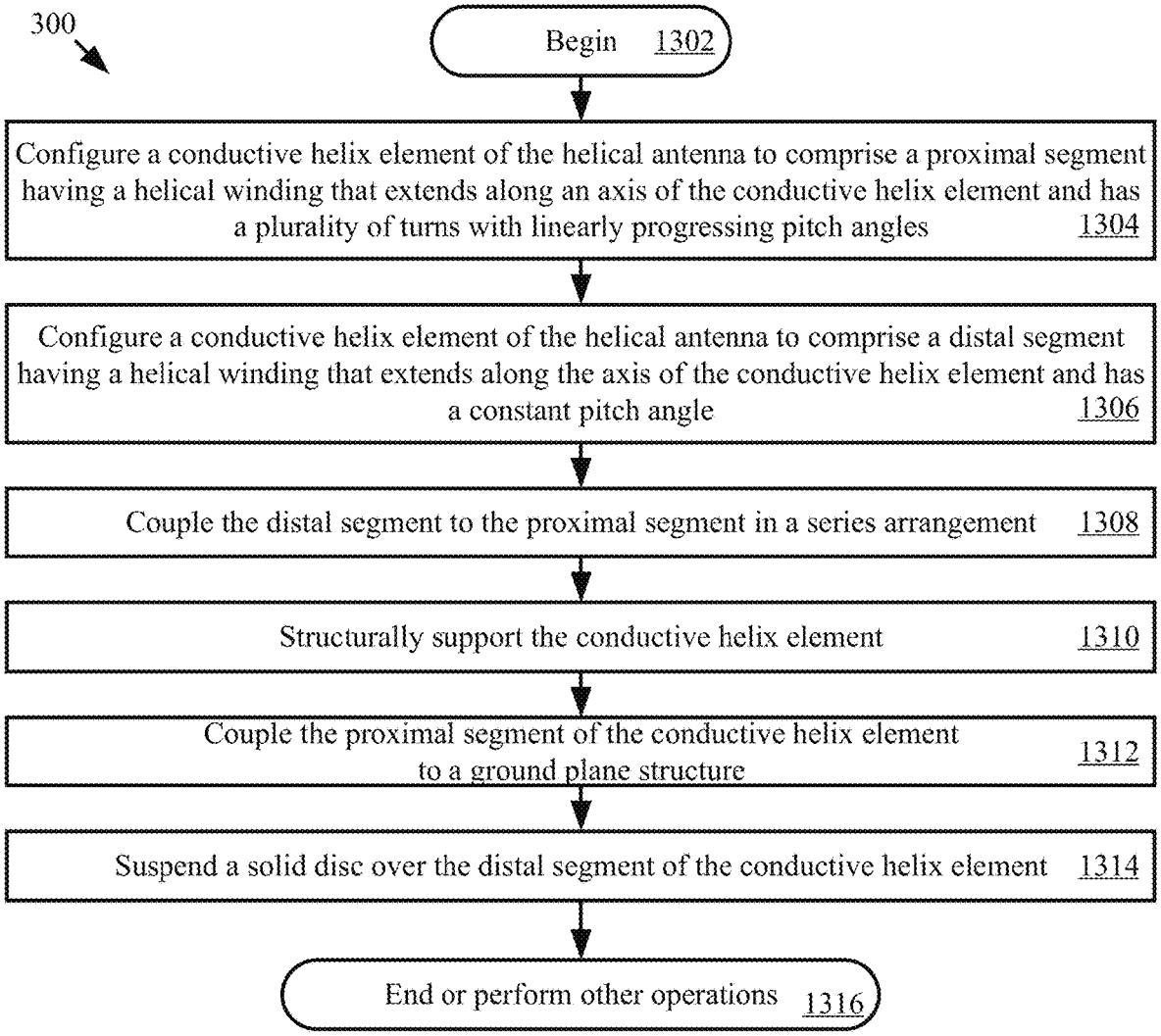
FIG. 13 provides a flow diagram of an illustrative method for improving an efficiency and a gain of a helical antenna.

Referring now to FIG. 13, there is provided a flow diagram of an illustrative method 1300 for improving an efficiency and a gain of a helical antenna (e.g., helical antenna 106 of FIGS. 1-6). Method 1300 begins with 1302 and continues with 1304 where a conductive helix element (e.g., conductive helix element 118 of FIGS. 1-6) of the helical antenna is configured to comprise a proximal segment (e.g., proximal segment 102 of FIGS. 1-6) having a helical winding that extends along an axis (e.g., axis 120 of FIG. 1) of the conductive helix element and has a plurality of turns with linearly progressing pitch angles. In 1306, the conductive helix element is configured to comprise a distal segment (e.g., distal segment 104 of FIGS. 1-6) having a helical winding that extends along the axis of the conductive helix element and has a constant pitch angle. The distal segment is coupled to the proximal segment in a series arrangement so that a radio wave traveling along the conductive helix element reaches a terminal velocity at a point of the coupling, as shown by 1308.

The helical windings of the proximal and distal segments may have constant diameters. The spacing between successive turns of at least the proximal segment's helical winding may be constant or varied along a line parallel to the axis. The linearly progressing pitch angles and the constant pitch angle may be selected so that a radio wave velocity matches a current velocity at any location along the length of the conductive helix element.

In 1310, the conductive helix element is structurally supported. This structural support can be achieved using an elongate support member (e.g., bar 124 of FIGS. 1-6) that is disposed inside of the conductive helix element and extends along the axis. Electrically conductive and electrically non-conductive materials are suitable for the elongate support member. The conductive helix element is mechanically coupled to the elongate support member using a plurality of struts (e.g., arms, struts or posts 126 of FIGS. 1-6). The elongate support member may be axially expansive. The conductive helix element may further be structurally supported by sewn longitudinal tapes, strings, or an outer fabric sleeve.

In 1312, the proximal segment of the conductive helix element is coupled to a ground plane structure. The ground plane structure comprises a deployable ground plane structure (e.g., ground plane structure 108 of FIG. 1) or a cup reflector (e.g., cup reflector 912 of FIG. 9). The deployable ground plane structure comprises a solid plate (e.g., solid plate 204 of FIG. 2) to which a webbed structure (e.g., webbed structure 210 of FIG. 2) is coupled via a plurality of joints (e.g., joints 206 of FIG. 2) such that the webbed structure is able to move in directions towards and away from the conductive helix element (e.g., as shown by arrow 212 of FIG. 2). The ground plane 108 structure provides single direction radiation and balun suppression of common mode feed cable currents.

In 1314, a solid disc (e.g., solid disc 908 of FIG. 9) may be suspended over the distal segment of the conductive helix element. Subsequently, 1316 is performed where method 1300 ends or other processing is performed (e.g., the antenna structure is used for communications of radio waves on earth or to/from space).

Although the present solution has been illustrated and described with respect to one or more implementations, equivalent alterations and modifications will occur to others skilled in the art upon the reading and understanding of this specification and the annexed drawings. In addition, while a particular feature of the present solution may have been disclosed with respect to only one of several implementations, such feature may be combined with one or more other features of the other implementations as may be desired and advantageous for any given or particular application. Thus, the breadth and scope of the present solution should not be limited by any of the above described embodiments. Rather, the scope of the present solution should be defined in accordance with the following claims and their equivalents.

What is claimed is:

1. A method for improving an efficiency and a gain of a helical antenna, comprising:

configuring a conductive helix element of the helical antenna to comprise a proximal segment having a helical winding that extends along an axis of the conductive helix element and has a plurality of turns with linearly increasing pitch angles, wherein a pitch angle of a most proximal turn is smaller than a pitch angle of a most distal turn in the proximal segment;

configuring the conductive helix element to comprise a distal segment with a first end located adjacent to the most distal turn of the proximal segment, the distal segment having a helical winding (i) starting from the first end and extending along the axis of the conductive helix element and (ii) comprising a plurality of turns with a constant pitch angle; and coupling the distal segment to the proximal segment in a series arrangement so that a radio wave traveling along the conductive helix element reaches a terminal velocity at a point of the coupling.

2. The method according to claim 1, further comprising structurally supporting the conductive helix element using an elongate support member that is disposed inside of the conductive helix element and extends along the axis.

3. The method according to claim 2, wherein the conductive helix element is mechanically coupled to the elongate support member using a plurality of struts.

4. The method according to claim 2, wherein the elongate support member is axially expansive.

5. The method according to claim 2, wherein the conductive helix element is further structurally supported by sewn longitudinal tapes or an outer fabric sleeve.

6. The method according to claim 1, further comprising coupling the proximal segment of the conductive helix element to a ground plane structure.

7. The method according to claim 6, wherein the ground plane structure comprises a deployable ground plane structure or a cup reflector.

8. The method according to claim 7, wherein the deployable ground plane structure comprises a solid plate to which a webbed structure is coupled via a plurality of joints such that the webbed structure is able to move in directions towards and away from the conductive helix element.

9. The method according to claim 1, further comprising selecting the linearly increasing pitch angles and the constant pitch angle so that a radio wave velocity matches a current velocity at any location along the length of the conductive helix element.

10. The method according to claim 1, further comprising suspending a solid disc over the distal segment of the conductive helix element.

11. The method according to claim 1, wherein the proximal segment and the distal segment comprise two separate parts that are mechanically or inductively coupled to each other.

12. The method according to claim 1, wherein the first end of the distal segment at least partially overlaps the most distal turn of the proximal segment.

13. A helical antenna, comprising:

a conductive helix element comprising a proximal segment having a helical winding that extends along an axis of the conductive helix element and has a plurality of turns with linearly increasing pitch angles such that a pitch angle of a most proximal turn is smaller than a pitch angle of a most distal turn in the proximal segment, and a distal segment comprising a first end located adjacent to the most distal turn of the proximal segment and having a helical winding (i) starting from the first end and extending along the axis of the conductive helix element and (ii) comprising a plurality of turns with a constant pitch angle;

wherein the distal segment is coupled to the proximal segment in a series arrangement so that a radio wave traveling along the conductive helix element reaches a terminal velocity at a point of the coupling.

14. The helical antenna according to claim 13, further comprising an elongate support member disposed inside of the conductive helix element and extends along the axis so as to provide structural support to the conductive helix element.

15. The helical antenna according to claim 14, wherein the conductive helix element is mechanically coupled to the elongate support member using a plurality of struts.

16. The helical antenna according to claim 14, wherein the elongate support member is axially expansive.

17. The helical antenna according to claim 14, wherein the conductive helix element is further structurally supported by sewn longitudinal tapes or an outer fabric sleeve.

18. The helical antenna according to claim 13, further comprising a ground plane structure to which the proximal segment of the conductive helix element is coupled.

19. The helical antenna according to claim 18, wherein the ground plane structure comprises a deployable ground plane or a cup reflector.

20. The helical antenna according to claim 19, wherein the deployable ground plane structure comprises a solid plate to which a coil structure is coupled via a plurality of joints such that the coil structure is able to move in directions towards and away from the conductive helix element.

21. The helical antenna according to claim 13, wherein the linearly increasing pitch angles and the constant pitch angle are selected so that a radio wave velocity matches a current velocity at any location along the length of the conductive helix element.

22. The helical antenna according to claim 13, further comprising a solid disc suspended over the distal segment of the conductive helix element.

* * * * *